United States Patent [19]

Zahn

[11] 4,167,956

[45] Sep. 18, 1979

[54] SMALL CONTAINER FOR LIQUID GAS

[76] Inventor: Hermann Zahn, Henselstrasse 5, 6000 Frankfurt am Main, Fed. Rep. of Germany

[21] Appl. No.: 779,527

[22] Filed: Mar. 21, 1977

[30] Foreign Application Priority Data

Apr. 2, 1976 [DE] Fed. Rep. of Germany ..... 2614207

[51] Int. Cl.[2] ..... B65B 3/04; B67C 3/02

[52] U.S. Cl. ..... 141/84; 141/292; 141/351; 141/367; 141/379; 215/321; 222/486; 222/506

[58] Field of Search ..... 141/84, 291, 292, 293, 141/302, 285, 367, 379, 381, 384, 351; 222/481, 482, 506, 562; 215/317, 321

[56] References Cited

U.S. PATENT DOCUMENTS

| | | | |
|---|---|---|---|
| 297,174 | 4/1884 | Seymour | 222/482 |
| 2,543,163 | 2/1951 | Greiner | 222/481 |
| 2,684,182 | 7/1954 | Gey | 222/482 |
| 3,200,998 | 8/1965 | Mahar | 222/482 |
| 3,653,416 | 4/1972 | Hocq | 141/367 |

FOREIGN PATENT DOCUMENTS

| | | | |
|---|---|---|---|
| 978159 | 11/1975 | Canada . | |
| 206316 | 11/1959 | Fed. Rep. of Germany | 215/317 |
| 1248664 | 11/1960 | France | 222/482 |
| 2055952 | 5/1971 | France . | |
| 879498 | 10/1961 | United Kingdom . | |
| 1303397 | 1/1973 | United Kingdom . | |

*Primary Examiner*—Richard R. Stearns
*Attorney, Agent, or Firm*—Spencer & Kaye

[57] ABSTRACT

The invention relates to a small container for liquid gases for filling of the various types of gas lighters having various forms of intake valves. This is achieved by the small container for liquid gas according to the invention, wherein the bottom member and the top member at the two ends of the container are each provided with a self-acting, normally closed outlet valve and these two valves are different from each other and are adapted for filling-up the gas tanks of different types of gas lighters.

The container is also provided with a single cover cap to cover one or the other end of the container and the respective valve selectively. The container and the cover cap are provided with matched snap-in portions in one embodiment. In a further embodiment the cover cap and the ends of the container are provided with members for joining the cover cap and the end of the container in a relatively tight sliding fit and thus to secure the cover cap over the valve which it is desired to cover.

4 Claims, 2 Drawing Figures

SMALL CONTAINER FOR LIQUID GAS

The invention relates to a small container for liquid gas for filling-up of lighters, the container consisting of plastic material and/or sheat metal, particularly a bottle for filling comprising a preferably cylindrical casing closed by means of a bottom member and a top member.

Various types of gas lighters are now commercially available which are operated with gas, especially with liquid gas. These gas lighters are provided with an intake valve, which is mostly located in the bottom portion of the lighter, so that the tank of the lighter can be filled up with gas or liquid gas. This intake valve is normally maintained in the closed position by means of an inner compression or tension spring, which presses a movable member of the intake valve against a seat or sealing surface and against the bottom of the gas tank of the gas lighter. This movable member of the intake valve of the gas lighter contains a guide portion, for example in the form of a blind hole, and a sealing surface. When the lighter is filled with gas a filling tube on the gas container or gas bottle is inserted into the guide of the gas lighter intake valve. This filling tube is also provided with a matching sealing surface abutting the sealing surface of the gas lighter. In order to fill the gas tank of the gas lighter with gas from the liquid gas container or gas bottle, the gas lighter is then pushed against the gas bottle and at first the intake valve of the gas lighter and then the outlet valve of the filling container are opened and the gas passes or flows from the filling container or gas bottle into the gas lighter.

The gas lighters now commercially available throughout the world due to their various manufacture also contain various forms and types of intake valves, which have different guides as well as different sealing surfaces. This has caused difficulties in filling the various types of gas lighters with the single outlet or filling valve provided on one gas bottle.

A known approach to overcome these difficulties consists in providing adapters together with the gas containers, which are selectively placed over the original filling or outlet valve of the gas container, in order to make it possible to use the gas container for filling different models of gas lighters with various forms of intake valves.

However, such gas containers with adapters have a number of disadvantages. The adapters are loosely packed together with the gas container and are easily lost. On the other hand, such adapters are difficult to handle and therefore the purchaser of the gas container often is not able to handle them easily. Furthermore, the user of such a gas container with adapters does not always know firsthand, which adapter or portion of a multiple type adapter must be put over the outlet valve of the gas container for a certain type of gas lighter.

In the British Pat. No. 876,131 a gas bottle with a filling of carbon dioxide is described, which is used connected to beer barrels and is provided with several valves. However, this known gas bottle is intended for very high pressures and these valves are adapted thereto.

This results in the objective of the invention to provide a small container for liquid gas, particularly a filling bottle which is suitable for filling different forms of gas lighters having different intake valves without difficulties.

In accordance with the invention this object is achieved by providing a small container for liquid gas made from plastic material and/or sheet metal for filling lighters, wherein the bottom member and the top member of the filling bottle are each provided with a self-acting, normally closed outlet valve, these two valves being different from each other for the purpose of filling up different types of gas lighters.

In a further embodiment of the invention a cover cap is provided and can selectively be put over the bottom member or the top member of the gas container and over the outlet valve contained thereon. This cap preferably consists of an elastic plastic material.

At least one end of the casing or wall member of the filling bottle advantageously is provided with a thickened rim or bulge portion and the rim of an inserted form piece is formed against this bulge portion.

Furthermore, advantageously the cover cap has an inside annular groove, in which the bulge portion of the casing of the filling bottle can be snapped in. In order to adapt the shape of the cover cap so that it can be exchanged easily between the top and bottom end of the container, this cap is provided with an inside upper toroidal bulge, having a lower annular surface which forms the upper part of the annular groove. Furthermore, the cover cap has an inside lower toroidal bulge with an upper annular surface which forms the lower part of the annular groove. In this manner even after extended use the annular groove of the cover cap can still be used and snapped over the bulge portion of the filling-up bottle.

In a further embodiment the lower outlet valve of the filling bottle is secured in a tubular central portion of the form piece.

In a further preferred embodiment of the invention, no snap-in action is provided between the cover cap and the two ends of the bottle. The bottom member at one end of the bottle contains a central cylindrical shoulder portion in which one of the two outlet valves is secured and the cover cap has an inner cup-shaped portion with a relatively tight sliding fit over said cylindrical central shoulder portion on the first bottom member, and the cover cap has a further outer cylindrical, cup-shaped portion with a relatively tight sliding fit in a cup portion formed in the other second bottom member of the gas container. This embodiment of the small liquid gas container is very advantageous because of its simple, reliable design, and the bottom members and cover cap can be easily manufactured, for example by die casting of plastic materials or metals.

The invention together with its objectives and advantages will become more readily apparent from the following description of embodiments of the invention by way of example in connection with the attached drawings, in which:

FIG. 1 shows a first embodiment of the small container for liquid gas according to the invention, and illustrates two possible forms of the outlet valves and top and bottom members, and FIG. 2 shows still another embodiment of the invention with a particular advantageous configuration of a cover cap and the matching portions at the two ends of the container.

Figure 1:
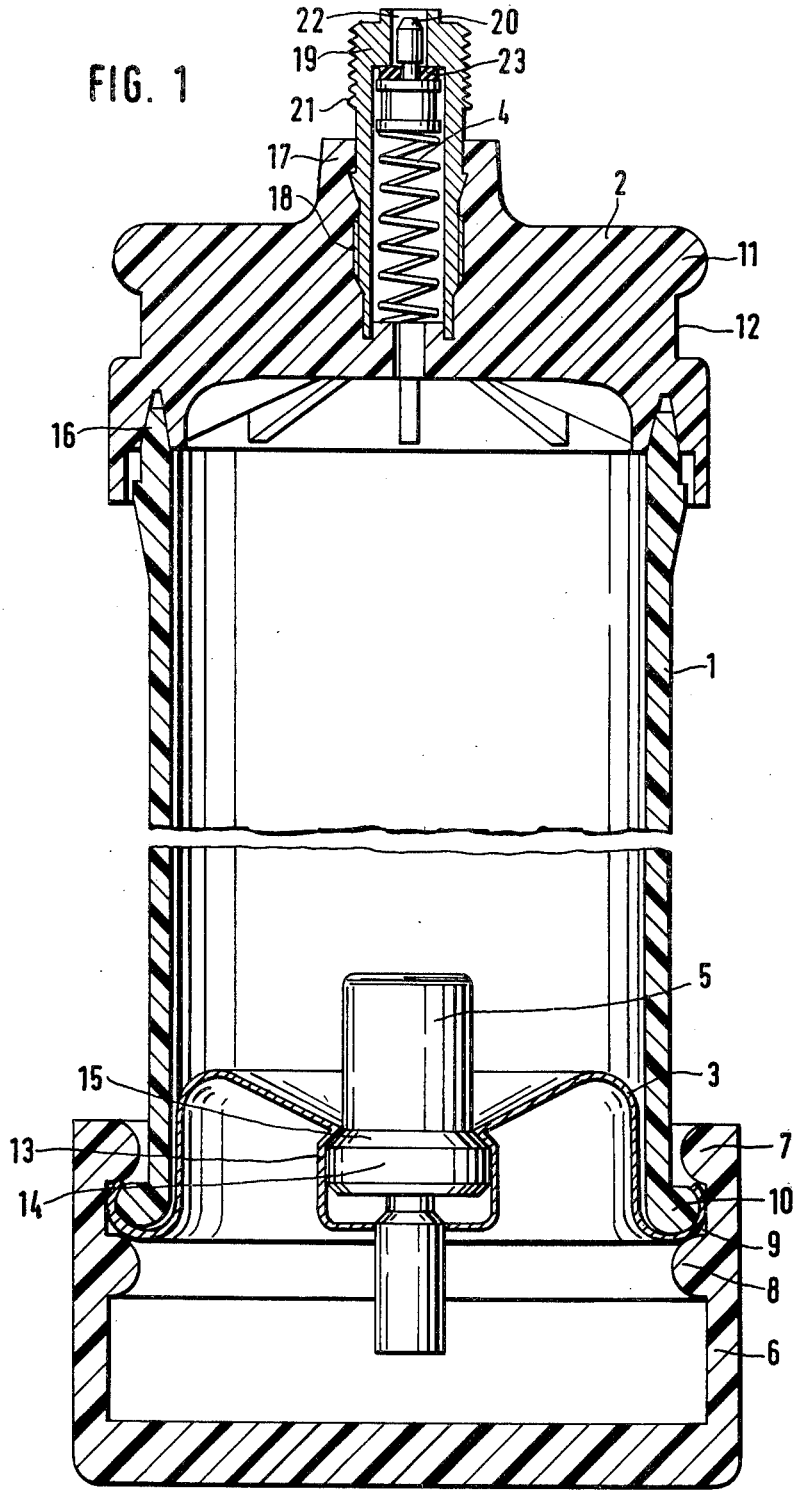
FIG. 1 shows an embodiment of the inventive gas container comprising a casing or wall portion 1, which in this case is cylindrical, and the two bottoms 2 and 3, which could also be designated as a lower bottom or bottom member 2 and upper bottom member or top member 3. The bottoms 2 and 3 are joined to the casing 1 by suitable means to obtain a leak tight connection and closure of the container, which can withstand the gas pressure inside the gas filled container. Two different outlet valves 4 and 5 are contained in the two bottoms 2 and 3. Furthermore, a cover cap or cap 6 is shown in position to cover the bottom 3 and the outlet valve 5. This cover cap 6 consists of a relatively rigid, elastic plastic material and may be manufactured by means of casting, die casting under pressure, or any other suitable method. It has an outer bulge portion or thickened portion 7 which is nearer to the open end of the cap than a second inner bulge portion 8, and an annular groove 9 is formed between the two bulge portions 7 and 8. When it is desired to put the cover cap 6 over the lower valve 5, the outer bulge portion 7 is pushed over a bulge portion 10 at the lower end of the casing 1 of the gas bottle, so that the bulge portion 10 snaps into the annular groove 9 in the cover cap 6.

If it is desired to use the lower outlet valve 5 of the gas bottle for filling up a gas lighter having a form of the intake valve which matches the form of the outlet valve 5, then the cover cap 6 is lifted off the lower valve 5 and is put over the upper bottom 2 to cover the valve 4. The upper bottom 2 in the embodiment illustrated by way of example is a form piece of a plastic material and is provided with a bulge portion 11 and an annular groove 12. The outer diameter of the bulge portion 11 is approximately equal to the inner diameter of the annular groove 9 of the cover cap 6 and the inner diameter of the annular groove 12 on the bottom member 2 is substantially equal to the outer diameter of the bulge portion 7 on the cover cap 6. Therefore, when the cover cap 6 is put over the bottom member or the form piece 2, the bulge portion 7 snaps into the annular groove 12 and the bulge portion 11 on the bottom member 2 snaps into the annular groove 9 on the cover cap 6.

Of course a second cover cap 6 might be provided for covering the second valve 4 on the upper bottom member 2. However, for legal reasons (Regulations for Storage of Compressed Gases) this is not necessary, since on one hand the amount of gas stored is relatively small and on the other hand the valve is short and sufficiently robust. It is therefore possible, permissible, and preferred to provide a single cover cap to selectively cover one of the two valves of the gas bottle.

The lower bottom member 3 of the gas bottle in this embodiment is a form piece consisting of a sheet material. In the embodiment illustrated in FIG. 1, the form piece for the bottom member 3 consists of a sheet metal. However, it may also consist of a formed piece made from a sheet of plastic material.

The bottom member 3 is generally cup shaped and contains a dome shaped portion portion drawn inwards and a tubular portion 13. The valve 5 is not shown in cross section, and is inserted in this tubular portion 13 and is secured in it by the bottom 3 being press-formed against a central portion 14 and a conical shoulder 15 of the valve 5.

During the manufacture of the gas bottle, the bottom member 3 together with the already inserted valve 5 is placed into the end of casing 1 and thereafter by means of a suitable process the outer rim of the cup shaped bottom member 3 is formed over the bulge portion 10 in the casing 1, so that a mechanically rigid and well sealed joint of the two parts is achieved. As already explained, in addition to its function of joining the bottom member 3 with the casing 1, the bulge portion 10 in the casing 1 also serves to snap-in the cover cap 6.

In addition to the pressing of the edge or rim portion of the cup shaped form piece of the bottom member 3 against the bulge portion 10 of the casing 1, a bonding agent may be inserted at the joint or a weld may be used (the latter especially for joining a bottom member 3 consisting of a plastic material with a casing 1 made from a plastic material).

The upper bottom member 2 of the gas bottle shown in FIG. 1 is a form piece consisting of a plastic material and, for example, may be manufactured by means of pressing or casting, or any other convenient method for shaping plastic materials.

The upper edge of the casing 1 is thickened and wedge shaped and is inserted into a matching wedge shaped groove 16 on the bottom member 2. At the outer surface of the bottom member 2 a central, integral shoulder or extension 17 is provided, having a hole 18 in which the valve 4 together with a surrounding sleeve 19 is inserted. Valve 4 and sleeve 19 are secured in the hole 18 by means of threads or a bonded joint. The sleeve 19 encloses the central movable part 20 of the valve 4 and is provided with external threads 21 at its upper end. When filling a lighter, the threads 21 of the sleeve 19 are screwed into a threaded hole, not shown, on the gas lighter. During this action, the projecting movable part of the gas lighter, which is disposed in the bottom of this threaded hole on the lighter, by way of the hole 22 in the sleeve 19 comes into contact with the central movable part 20 of valve 4 on the gas bottle. On continuing to screw the threads 21 into the gas lighter, at first the movable part of the intake valve of the gas lighter is pushed inwards and thereby this intake valve is opened and the gas lighter is vented. Subsequently, the movable part 20 of the outlet valve 4 on the gas bottle is pushed inwards and the valve is opened, so that the gas can flow from the gas bottle into the gas lighter.

In an embodiment of the valve 4 in accordance with FIG. 1, the movable part 20 is inserted in the sleeve 19 and the outlet valve 4 of the gas bottle is thus protected even without being protected by means of a second cover cap when the gas bottle is not used to fill up a lighter. When the lower outlet valve 5 is to be used for filling up a gas lighter, the cover cap 6 can be lifted off the end of the gas bottle containing the valve 5 and can be put over the upper bottom member 2 for easier handling of the gas bottle. A rubber sealing ring 23 may be provided at the outlet valve 4 within the sleeve 19 and below the movable valve member 20.

Figure 2:
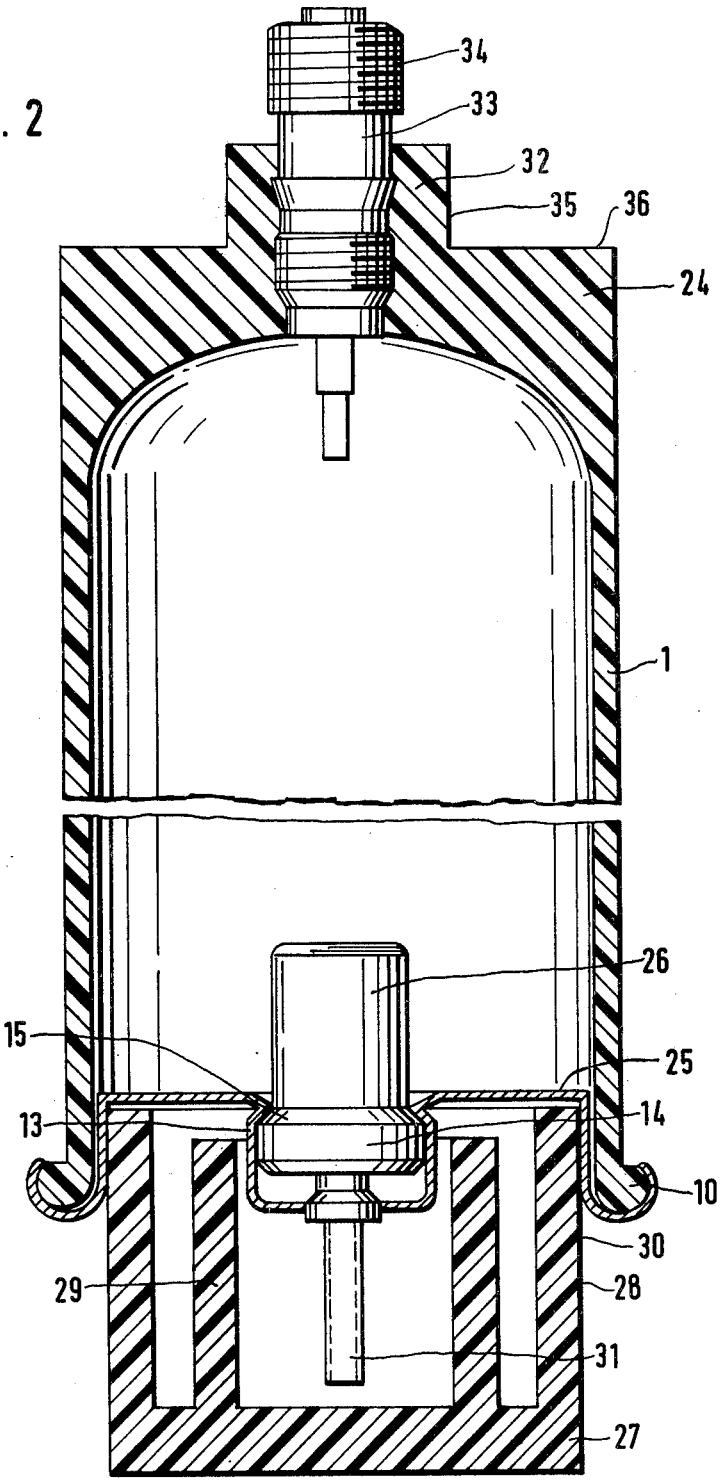

FIG. 2 shows a sectional view of still another embodiment of the invention with a particular advantageous configuration of the cover cap and matching portions on the ends of the gas container. An enlarged scale is used in order to show various details more clearly. The gas container or gas bottle comprises a casing or wall portion 1 and two bottoms 24 and 25 closing the casing 1 at both ends to form a bottle. The bottom 24 shown in the upper position in the drawing is an integral part of the casing 1, but may also consist of a form piece similar to the form piece of the bottom 2 shown in FIG. 1. The bottom 24 and the casing 1 consist of a plastic material, but other materials may also be used. The lower bottom 25 in the embodiment shown consists of sheet metal and some details of this lower bottom 25 and its leak-tight connection with the lower outlet valve 26 are similar to the respective portions of the embodiment shown in FIG. 1, as indicated by use of the reference numbers 10, 13, 14, and 15 of said figure.

The lower part of FIG. 2 shows the different type of cover cap or cap 27. This cover cap has a very simple and efficient design and obviates the use of a snap-in action and the respective bulge and groove portions on the ends of the bottle and on the cover cap. The cover cap 27 comprises a cylindrical, cup-shaped outer portion 28 and cylindrical, cup-shaped inner portion 29. The function of the inner portion 29 of cap 27 will be explained below in connection with the description of the upper bottom 24. The outer cupshaped portion 28 has an outer surface 30, which is manufactured, for example by die casting of plastic material or metal, to give a relatively tight sliding fit together with the cup or cylinder formed by the lower bottom 25, and is thereby held in place when it is desired to keep the lower outlet valve 26 covered, as can be clearly seen from the drawing. The inner cup-shaped portion of cap 27 serves no particular function, when the cover cap is in the position as seen in FIG. 2. The lower outlet valve 26 is not shown in cross section. It is provided with a filling tube 31 for use together with matching types of gas lighters.

The upper bottom 24 has a cylindrical shoulder or projection 32, with a central hole into which the upper outlet valve 33 is inserted in a leak-tight suitable manner. In FIG. 2, the upper outlet valve 33 is not shown in cross section and in detail; any type of valve construction for the upper outlet valve 33 can be used, which is suitable for the intended use of the valve for filling-up of certain types of gas lighters. Especially, a type of valve and sleeve as described in connection with the valve 4 of FIG. 1 could be used. The upper end of outlet valve 33 is also provided with exterior threads 34, for threading into a matching threaded hole of a gas lighter. The upper outlet valve 33 can have an exterior portion consisting of brass or other convenient metals, or of a hard plastic material. As can be seen from FIG. 2, it has a robust construction and does not necessarily have to be covered when not in use.

When it is desired to use the lower outlet valve 26 for filling up a gas lighter, the cover cap 27 can be drawn out of the cylindrical cup formed by the lower bottom 25 and can be put over the upper end of the gas container carrying the outlet valve 33. The shoulder or projection 32 provided on the upper bottom portion 24 has a smooth and exact cylindrical surface 35 and the inner cylindrical, cup-shaped portion 29 of cover cap 27 can be pushed over this shoulder 32 and has a relatively tight sliding fit with the cylindrical surface 35 on the shoulder 32. This fit between the two parts 29 and 32 is tight enough to keep the cover cap 27 in this position covering the upper outlet valve 33. The ends of the outer cup-shaped portion 28 of cap 27 rest on the upper surface 36 of the bottom portion 24.

This configuration of a cover cap in connection with the gas container for liquid gases having a valve at both ends is very advantageous. It can be easily manufactured, for example by die casting of plastic materials or other materials to the desired tolerances, and does not require a complicated die for casting or a complicated tooling.

What I claim is:

1. A small container for liquid gas for filling gas lighters having differing intake valve designs comprising: a tubular side wall; a first end member being gas-tight connected to one end of the side wall, said first end member having an integral cylindrical central shoulder portion; a second end member being gas-tight connected to the opposite end of the side wall, said second end member having an inwardly extending cup-shaped portion; a first self-acting, normally closed gas discharge valve mounted in the first end member, said first gas discharge valve being openable for the discharge of gas by axial pressure and being designed for use with a first gas lighter intake valve; a second self-acting, normally closed gas discharge valve mounted in the second end member and being designed for use with a gas lighter intake valve of a design different than that of said first intake valve; and a cover-cap which can be selectively fitted over each of said end members to selectively cover the associated one of said first and second discharge valves, said cover-cap having an inner cylindrical cup-shaped portion capable of a relatively tight sliding fit over said cylindrical central shoulder portion of he first end member and having an outer cylindrical cup-shaped portion capable of a relatively tight sliding fit in the cup-shaped portion of the second end member.

2. The small container for liquid gas of claim 1, wherein said cover cap consists of an elastic plastic material.

3. The small container for liquid gas of claim 1, wherein at least one end of the side wall of the container contains a toroidal bulge portion.

4. The small container for liquid gas of claim 1, wherein said valves are mounted in central portions of said end members.

* * * * *